US006863015B2

(12) United States Patent
Nakajima

(10) Patent No.: US 6,863,015 B2
(45) Date of Patent: Mar. 8, 2005

(54) HULL OF PERSONAL WATERCRAFT AND METHOD OF MANUFACTURING THE SAME

(75) Inventor: Jun Nakajima, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/627,765

(22) Filed: Jul. 28, 2003

(65) Prior Publication Data

US 2004/0123790 A1 Jul. 1, 2004

(30) Foreign Application Priority Data

Jul. 30, 2002 (JP) ..... 2002-221079

(51) Int. Cl.[7] ..... B63B 5/24
(52) U.S. Cl. ..... 114/357
(58) Field of Search ..... 114/357, 355

(56) References Cited

U.S. PATENT DOCUMENTS 3,848,284 A * 11/1974 Livingston ..... 114/357
4,205,408 A * 6/1980 Glass et al. ..... 114/357
5,063,870 A * 11/1991 Wagner ..... 114/357
6,161,496 A * 12/2000 Fulks ..... 114/357

* cited by examiner

*Primary Examiner*—Ed Swinehart
(74) *Attorney, Agent, or Firm*—Birch, Stewart, Kolasch & Birch, LLP.

(57) ABSTRACT

A method of manufacturing a hull for a personal watercraft includes the step of spraying a resin and reinforcing fibers to a mold while mixing the resin and the reinforcing fibers and then solidifying the mixture of the resin and the reinforcing fibers to thereby produce an outer wall of the hull, the step of adding a box-like member to a predetermined portion of the outer wall, and the step of spraying a resin and reinforcing fibers to the box-like member and the outer wall while mixing the resin and the reinforcing fibers and then solidifying the mixture of the resin and the reinforcing fibers to thereby integrally attach the box-like member to the outer wall and form a hollow chamber. The hull is made according to this method.

20 Claims, 15 Drawing Sheets

HULL OF PERSONAL WATERCRAFT AND METHOD OF MANUFACTURING THE SAME

CROSS-REFERENCE TO RELATED APPLICATIONS

The present application claims priority under 35 USC 119 to Japanese Patent Application No. 2002-221079 filed on Jul. 30, 2002 the entire contents thereof are hereby incorporated by reference.

BACKGROUND OF THE INVENTION

1. Field of the Invention

The present invention relates to a hull of personal watercraft and a method of manufacturing the same.

2. Description of Background Art

A hull for a personal watercraft is known, for example, as disclosed in Japanese Patent No. 3111187 entitled "Personal Watercraft." The hull of the personal watercraft is shown in FIG. 15 of the figures attached hereto.

FIG. 15 is an illustration of a method of manufacturing the hull according to the prior art, and is a copy of FIG. 3 of the above-mentioned Japanese publication. The symbols used in the publication are used in FIG. 15.

A hull 2 is molded from a resin by use of a mold which is not shown in FIG. 15. Then, a bulkhead 7 and a hull inside member 8 are attached to the inside of the hull 2 with adhesive layers.

In the manufacture of the hull of the personal watercraft as above-mentioned, the bulkhead 7 and the hull inside member 8 are attached to the inside of the resin-molded hull 2 with the adhesive layers. However, when inside members such as the bulkhead 7 are adhered to the inside of the hull 2, much labor is used for the production. At the time of adhesion, it is necessary to convey the resin-molded hull 2 to an adhesion area on the downstream side where an adhesive applicator is provided, so that much labor is taken for dealing with the hull 2, and the production cost is raised.

In addition, at the time of adhering the hull inside member 8 to the inside of the hull 2, dispersion would easily be generated in the thickness of the adhesive applied to the gap between the surfaces to be adhered to each other, so that there is a fear of insufficient strength.

SUMMARY AND OBJECTS OF THE INVENTION

Accordingly, it is an object of the present invention to provide a hull of personal watercraft and a method of manufacturing the same wherein the production cost is reduced and the strength is enhanced.

In order to attain the above object, an outer wall of a hull is formed by spraying a resin and reinforcing fibers to a mold while mixing the resin and the reinforcing fibers and then solidifying the mixture of the resin and the reinforcing fibers, a box-like member is separately prepared to be added to a predetermined portion of the outer wall, and an inner wall of the hull is formed by spraying resin and reinforcing fibers to the box-like member and the outer wall while mixing the resin and the reinforcing fibers and then solidifying the mixture of the resin and the reinforcing fibers so as thereby to integrally attach the box-like member to the outer wall and to form a hollow chamber.

The resin and the reinforcing fibers are sprayed to the whole outside surface of the box-like member while mixing the resin and the reinforcing fibers, whereby walls of the hollow chamber are formed of the resin and the reinforcing fibers. As a result, the hollow chamber can be formed to be rigid.

In addition, since it is unnecessary to raise the strength of the box-like member, it is needless to provide the box-like member with a reinforcement structure such as, for example, plate pieces or grooves, and it is easy to produce the box-like member.

The box-like member is a member for supporting a drive shaft extending from an engine. The drive shaft is supported by the rigid hollow chamber formed of the box-like member and the inner wall.

The present invention includes the steps of spraying a resin and reinforcing fibers to a mold while mixing the resin and the reinforcing fibers and then solidifying the mixture of the resin and the reinforcing fibers to produce an outer wall of a hull. A separately prepared box-like member is added to a predetermined portion of the outer wall. Resin and reinforcing fibers are sprayed on the box-like member and the outer wall while mixing the resin and the reinforcing fibers and then solidifying the mixture of the resin and the reinforcing fibers so as thereby to integrally attach the box-like member to the outer wall and to form a hollow chamber.

In the step of integrally attaching the box-like member and forming the hollow chamber, the box-like member is integrally attached to the outer wall and the hollow chamber is formed by spraying the same resin and reinforcing fibers as those for forming the outer wall. Therefore, the step of producing the outer wall and the step of integrally attaching the box-like member and forming the hollow chamber can be continuously carried out at the same place, the adhesion step is omitted, and the labor for dealing with the outer wall attendant on the adhesion step is eliminated. Accordingly, production time of the hull is shortened.

The present invention also includes the step of producing the outer wall and the step of integrally attaching to the outer wall and forming the hollow chamber including press-forming a plurality of sprayed layers by a roller.

In the step of producing the outer wall, the outer wall is formed of two layers. First, the sprayed first layer is press-formed by the roller, so that the thickness of the first layer is made to be uniform, and the wall surface of the first layer is made to be flat. Similarly, the second layer is sprayed onto the first layer, and the sprayed second layer is press-formed by the roller, so that the thickness of the second layer is made to be uniform, and the wall surface of the second layer is made to be flat. Namely, the thickness of the outer wall is made to be uniform, and the wall surface of the outer wall is made to be flat.

In the step of integrally attaching to the outer wall and forming the hollow chamber, the sprayed third layer (inner wall) is press-formed by the roller, so that the thickness of the inner wall integrally attached to the outer wall is made to be uniform, and the wall surface of the inner wall is made to be flat.

The step of integrally attaching to the outer wall and forming the hollow chamber includes spraying a resin and reinforcing fibers to the whole outside surface of the box-like member while mixing the resin and the reinforcing fibers.

In the step of integrally attaching to the outer wall and forming the hollow chamber, the resin and the reinforcing fibers are sprayed to the whole outside surface of the box-like member while being mixed with each other, whereby the bonding force between the sprayed material (inner wall) and the outside surface of the box-like member is raised, and, simultaneously, the bonding force between the sprayed material and the outer wall is also raised, resulting in that the hollow chamber as a whole is made to be rigid.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will be described below based on the accompanying drawings.

Figure 1:
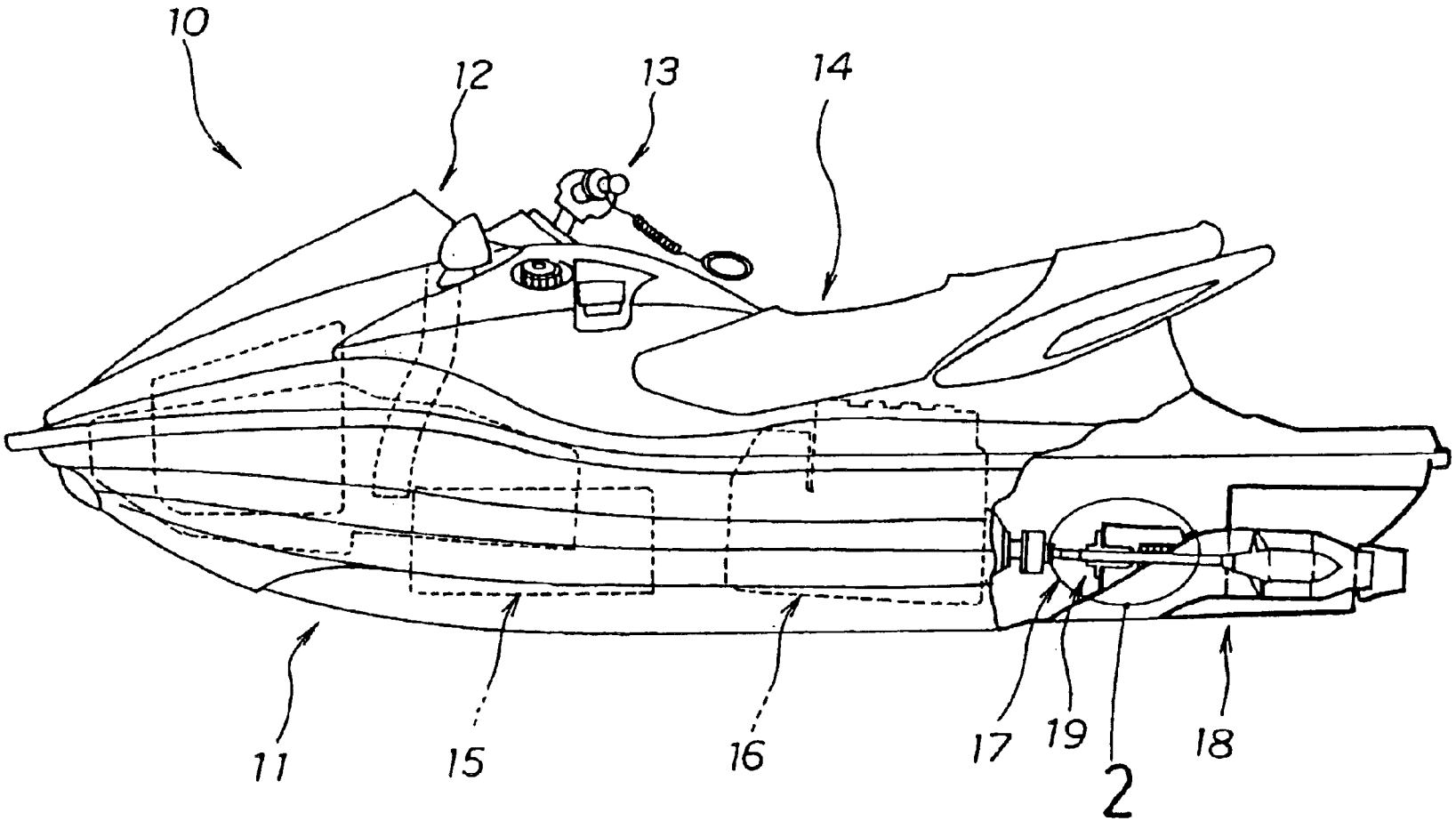
FIG. 1 is a side view of a personal watercraft including a hull according to the present invention.

FIG. 1 is a side view of a personal watercraft including a hull according to the present invention. The personal watercraft 10 includes a hull 11 constituting a lower portion of the watercraft 10, a deck 12 jointed to the upper side of the hull 11 to constitute an upper portion of the watercraft 10 and a steering handle 13 disposed at a roughly central position of the deck 12. A driver's seat 14 is provided on the rear side of the steering handle 13 adjacent to a fuel tank 15. An engine 16 is attached to the center of the hull 11 with a jet propeller 18 to be driven by the engine 16 through a drive shaft 17. A shaft bearing portion 19 is provided for supporting the drive shaft 17.

Figure 2:
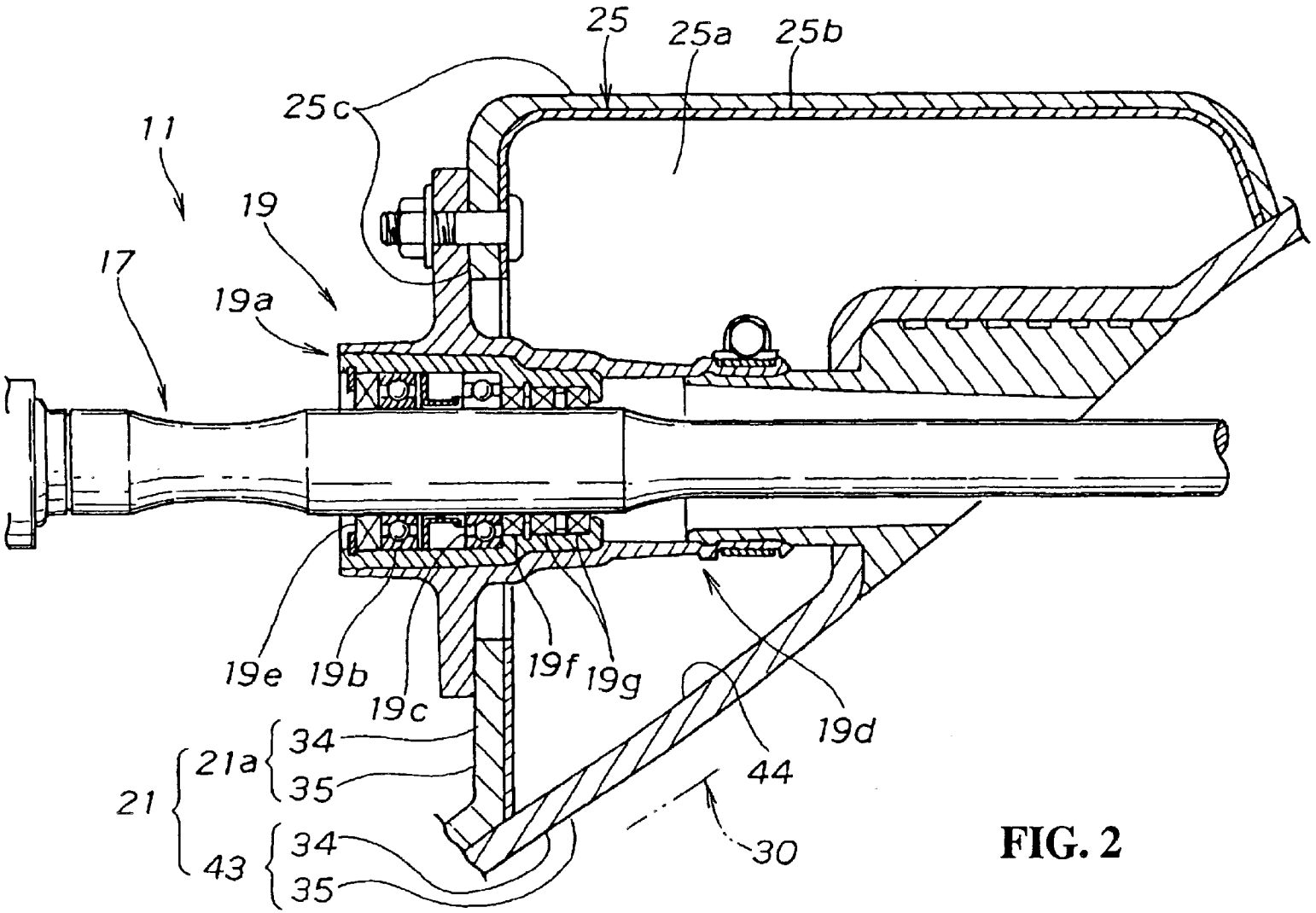
FIG. 2 is a detailed view of portion 2 of FIG. 1.

FIG. 2 is a detailed view of portion 2 of FIG. 1, and shows the hull 11 and the drive shaft bearing portion 19.

A main body 21 of the hull 11 includes an outer wall 43, and an inner wall 21*a* integrally adhered to the outer wall 43.

The drive shaft bearing portion 19 includes a bearing containing member 19*a* attached to the inner wall 21*a* and a box-like member 25, a first ball bearing 19*b* and a second ball bearing 19*c* which are attached to the bearing containing member 19*a*, and a water-proofing member 19*d*. First to third seal members 19*e* to 19*g* are provided.

Figure 3:
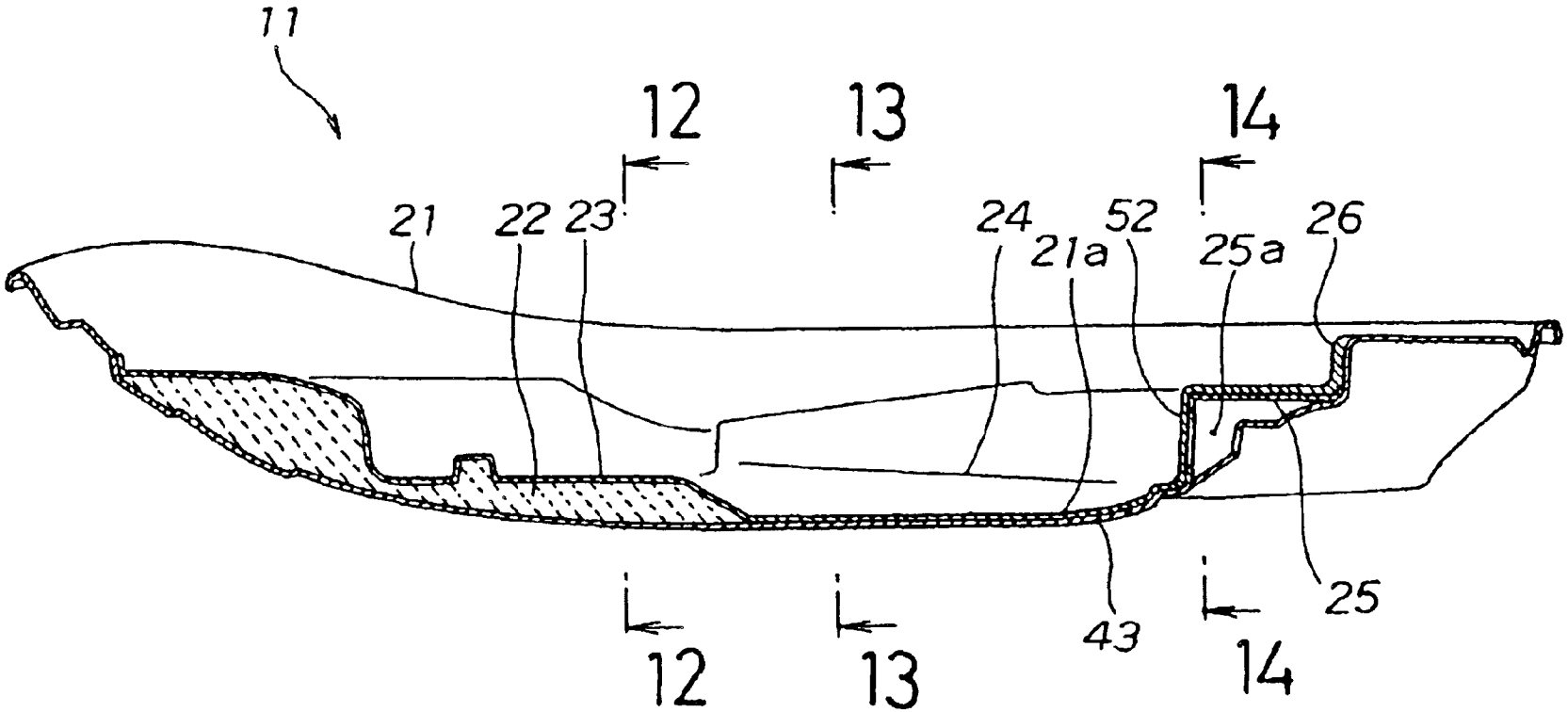
FIG. 3 is a sectional view of the hull according to the present invention.

FIG. 3 is a sectional view of the hull according to the present invention. The hull 11 includes the above-mentioned main body 21, a buoyancy member 22 attached to the center of the main body 21, a tank attaching mounting portion 23 formed at an upper portion of the buoyancy member 22, an engine mounting portion 24, the box-like member 25 attached on the rear side, and a hollow chamber 25*a* formed of the inner wall 21*a* and the box-like member 25. A rudder component mounting seat 26 is provided.

The material of the hull 11 is a composite material of a resin, including the resin and reinforcing fibers.

Now, a method of manufacturing such a hull 11 will be described.

Figure 4:
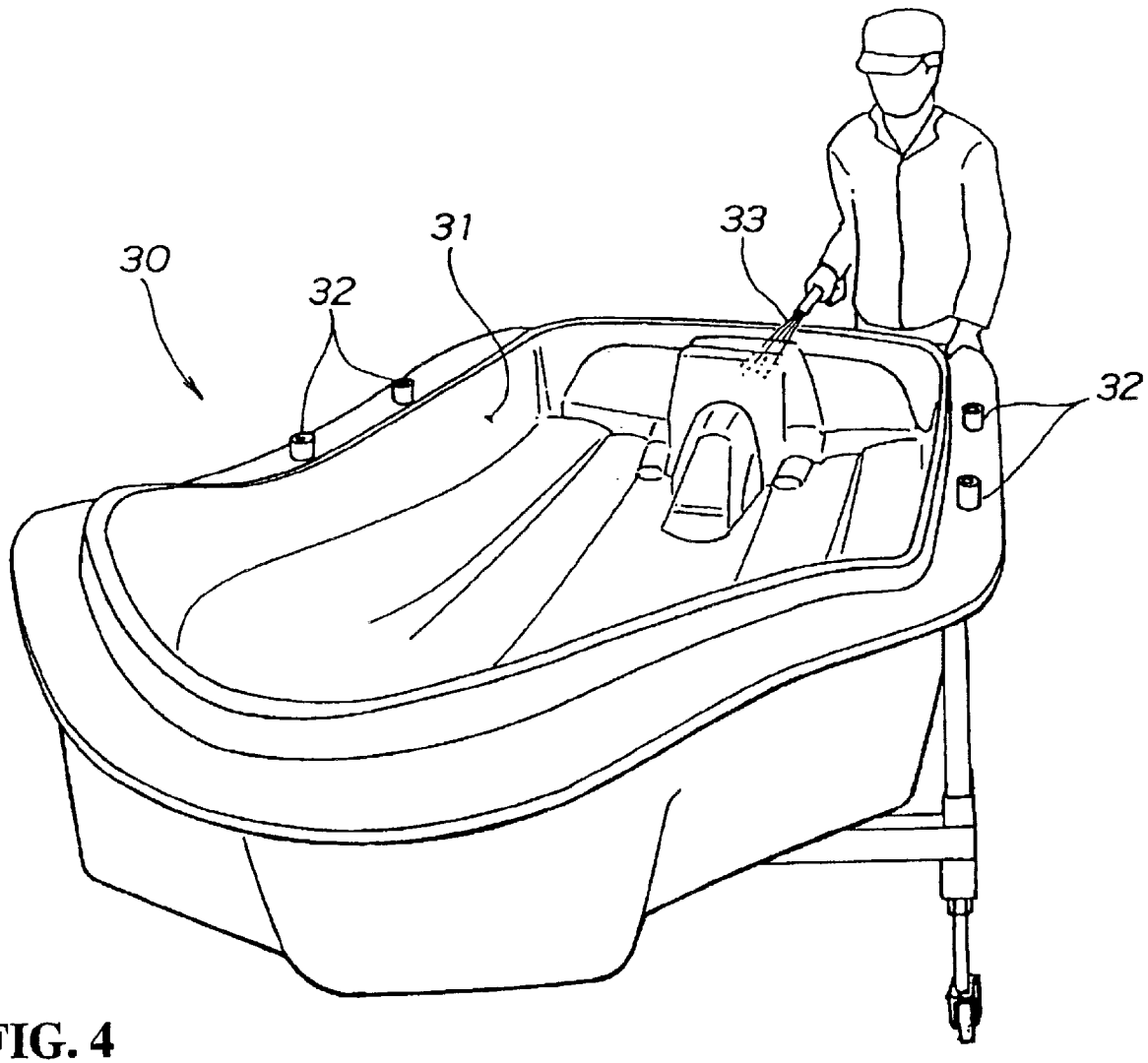
FIG. 4 is a first illustration of a method of manufacturing a hull according to the present invention.

FIG. 4 is a first illustration of the method of manufacturing the hull according to the present invention showing the step of producing the outer wall of the hull (No. 1).

First, a mold 30 is prepared. The mold 30 includes a mold surface 31 for forming the outer shape of the hull 11 (see FIG. 3), and positioning members 32 . . . ( . . . means a plurality, here and hereinafter) provided on the outer side of the mold surface 31.

A mold release agent 33 is applied to the mold surface 31 of the mold 30.

Figure 5:
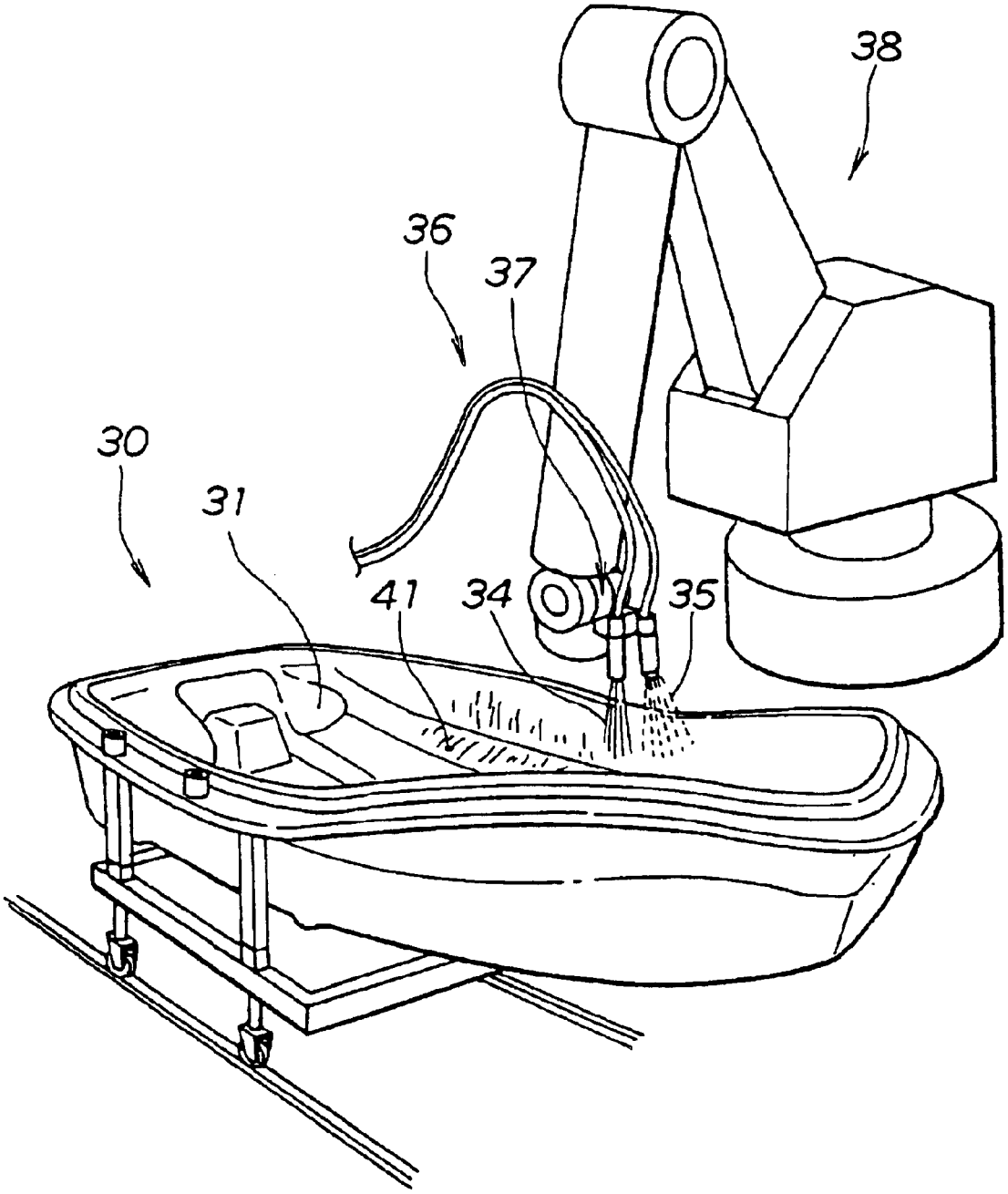
FIG. 5 is a second illustration of the method of manufacturing a hull according to the present invention.

FIG. 5 is a second illustration of the method of manufacturing the hull according to the present invention, showing the step of producing the outer wall (No. 2).

Next, a resin 34 and reinforcing fibers 35 are sprayed to the mold surface 31 while being mixed with each other. Here, a gun 37 of a sprayer 36 is attached to a robot 38, and the resin 34 and the reinforcing fibers 35 are mixed while being sprayed simultaneously, whereby the mixture 41 is built up to a predetermined thickness.

Incidentally, the timing of mixing the resin 34 and the reinforcing fibers 35 and the number of nozzles of the gun 37 are arbitrary. A system for mixing the resin 34 and the reinforcing fibers 35 in the nozzle and spraying the mixture or a system for spraying the resin 34 and the reinforcing fibers 36 by separate guns so as to mix them on the surface of the mold surface 31 may be arbitrarily adopted.

Figure 6:
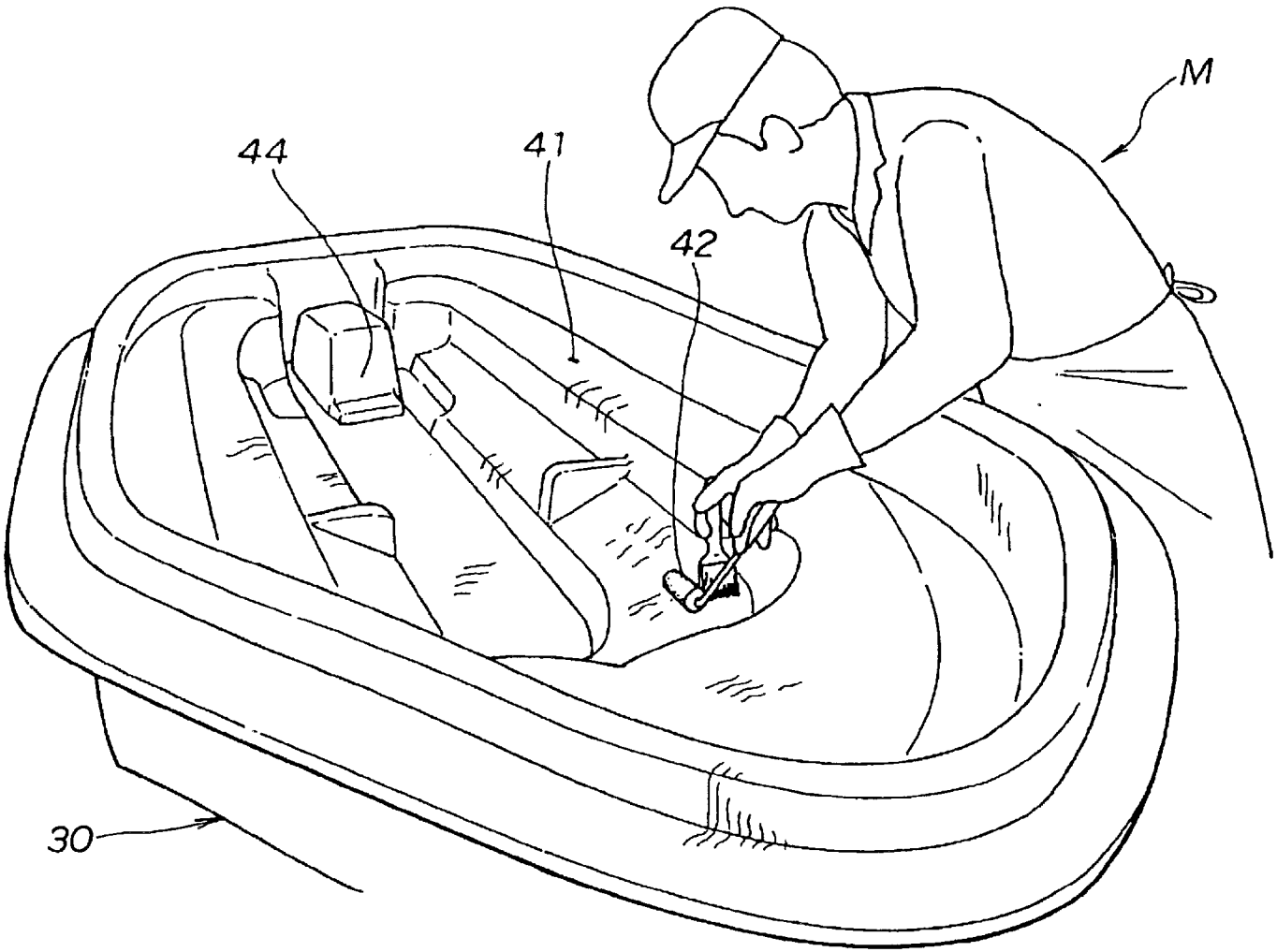
FIG. 6 is a third illustration of the method of manufacturing a hull according to the present invention.

FIG. 6 is a third illustration of the method of manufacturing the hull according to the present invention, and shows the step of producing the outer wall (No. 3).

The mixture 41 of the resin and the reinforcing fibers is pressed by a roller 42, in order to make the thickness of the mixture 41 uniform. By these operations, the first layer of the mixture 41 is completed. Subsequently, the second layer is formed in a predetermined thickness on the surface of the first layer.

The method of forming the second layer is the same as the method of forming the first layer; namely, as already shown in FIGS. 5 and 6, the mixture 41 is sprayed, and then the mixture of the second layer is pressed by the roller 42 by a worker M.

By thus integrally laminating the second layer on the first layer, the outer wall 43 as shown in FIGS. 2 and 3 is completed.

In the step of producing the outer wall, the first and second layers sprayed are press-formed by the roller 42, so that uniformization of the thickness of the outer wall 43 can be contrived, and the wall surface can be made flat.

Figure 7:
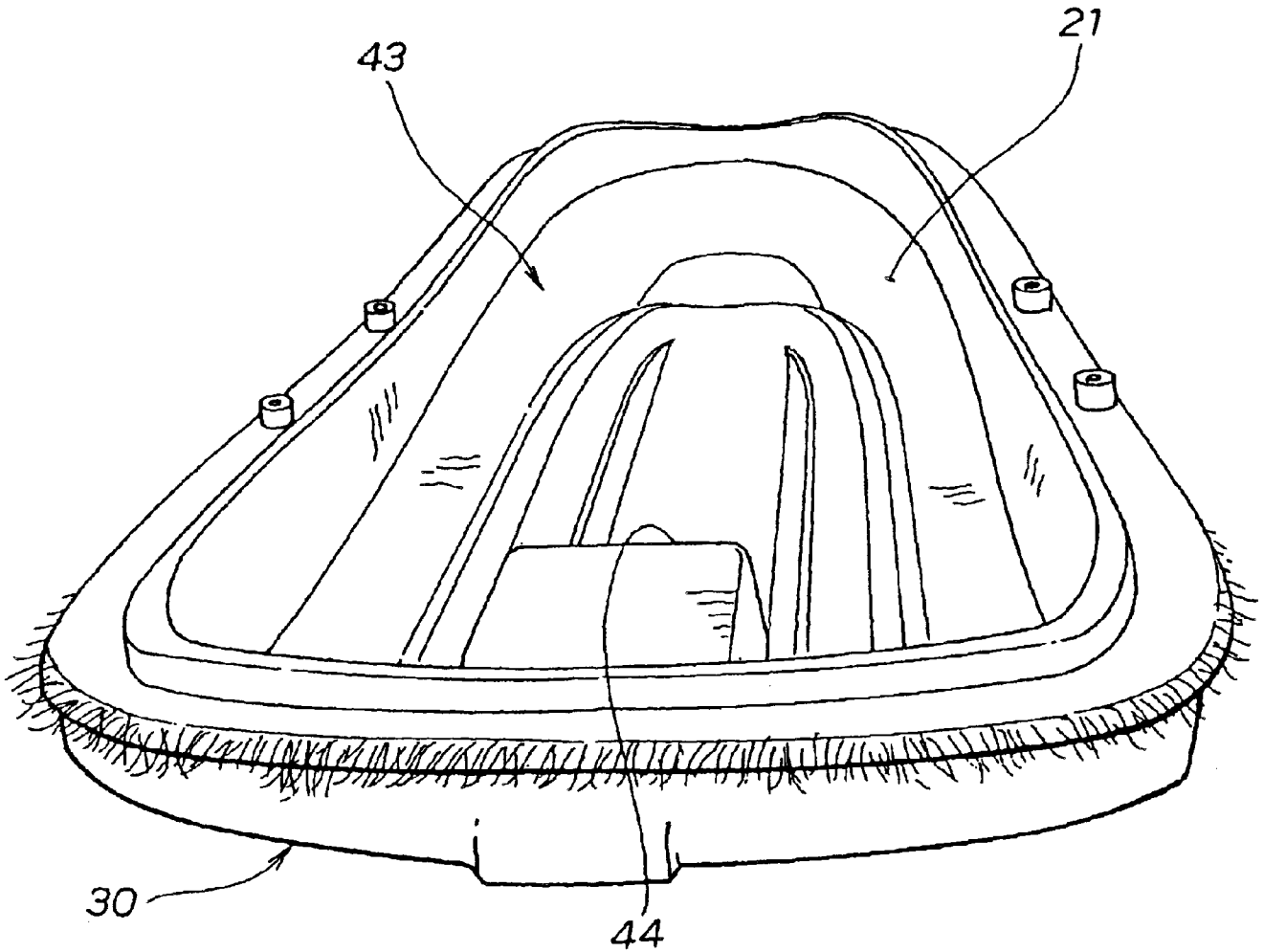
FIG. 7 is a perspective view of an outer wall of the hull manufactured by the method of manufacturing a hull according to the present invention.

FIG. 7 is a perspective view of the outer wall of the hull manufactured by the method of manufacturing the hull according to the present invention. The solidified condition of the resin constituting the outer wall 43 here is a soft condition. A predetermined portion 44 (see FIG. 6) is provided to which the box-like member is to be attached.

Figure 8:
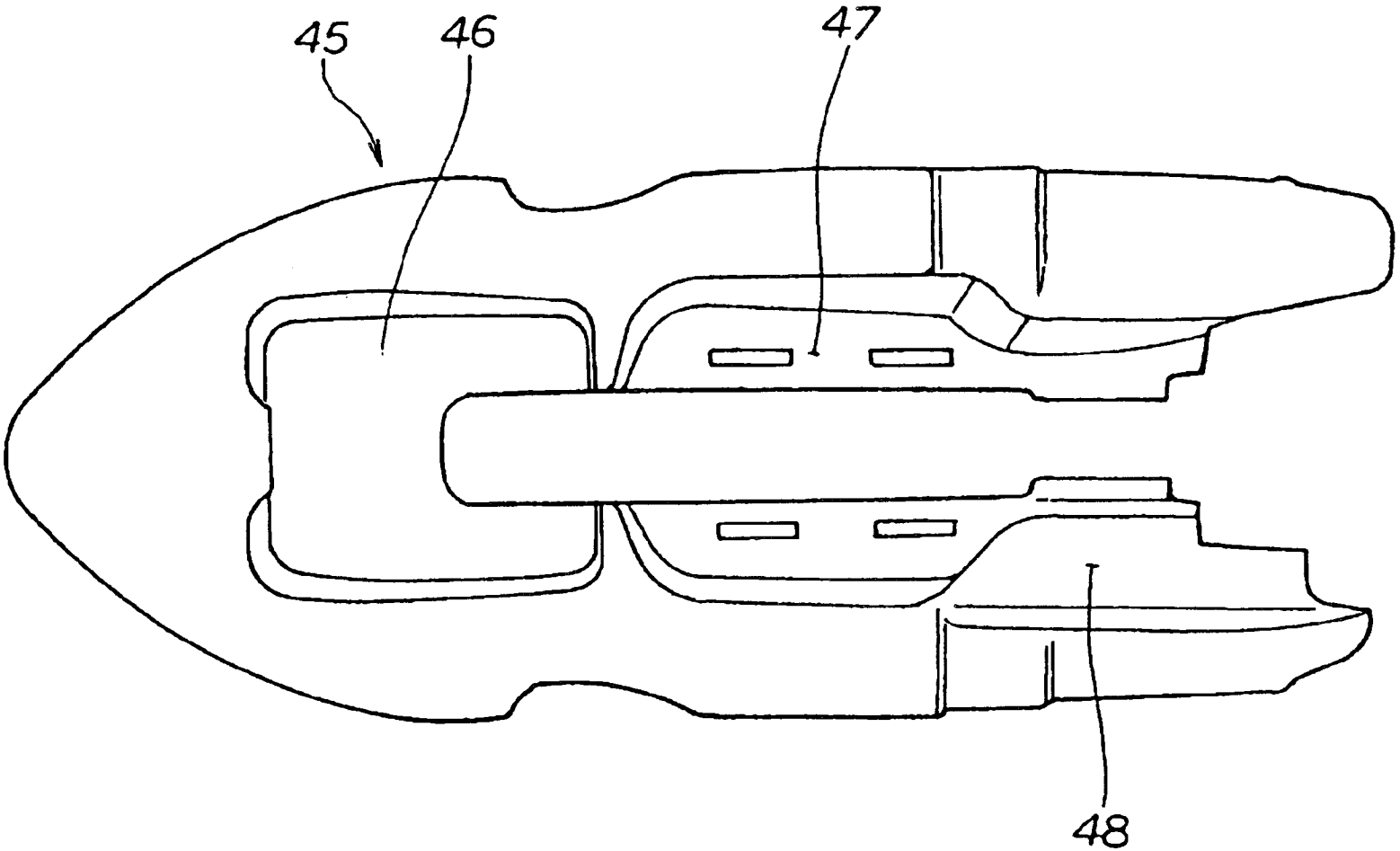
FIG. 8 is a fourth illustration of the method of manufacturing a hull according to the present invention.

FIG. 8 is a fourth illustration of the method of manufacturing the hull according to the present invention.

Here, a buoyancy member 45 to be attached to the outer wall 43 (see FIG. 7) is prepared. The buoyancy member 45 includes a tank portion 46, an engine portion 47, and an exhaust pipe portion 48. The material of the buoyancy member 45 is a foamed material.

Figure 9:
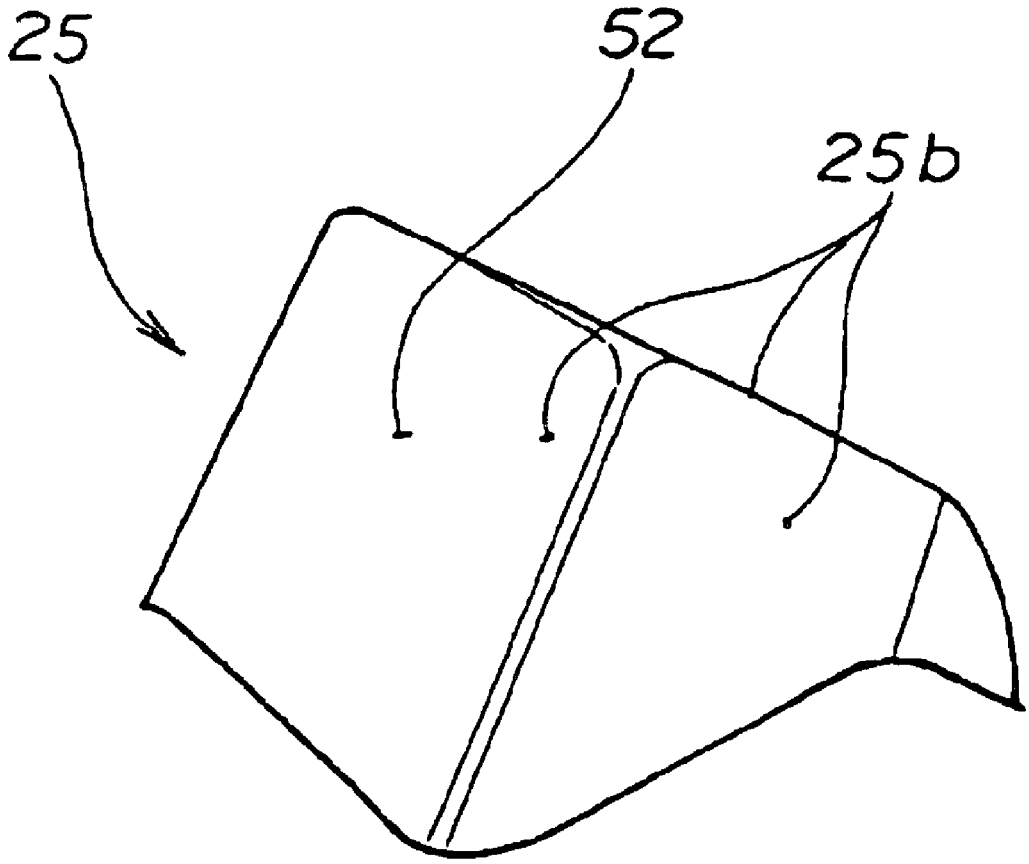
FIG. 9 is a fifth illustration of the method of manufacturing a hull according to the present invention.

FIG. 9 is a fifth illustration of the method of manufacturing the hull according to the present invention, and shows the step of adding the box-like member (No. 1).

The box-like member 25 to be attached to the outer wall 43 (see FIG. 7) is prepared. The box-like member 25 is a member for supporting and providing a bearing for the drive shaft 17 (see FIG. 1), and includes a seat portion 52 through which the drive shaft penetrates and by which the drive shaft is borne through the shaft bearing portion 19 (see FIG. 2). Outside surfaces 25*b* are provided on the box-like member 25.

The material of the box-like member 25 is, for example, resin.

Figure 10:
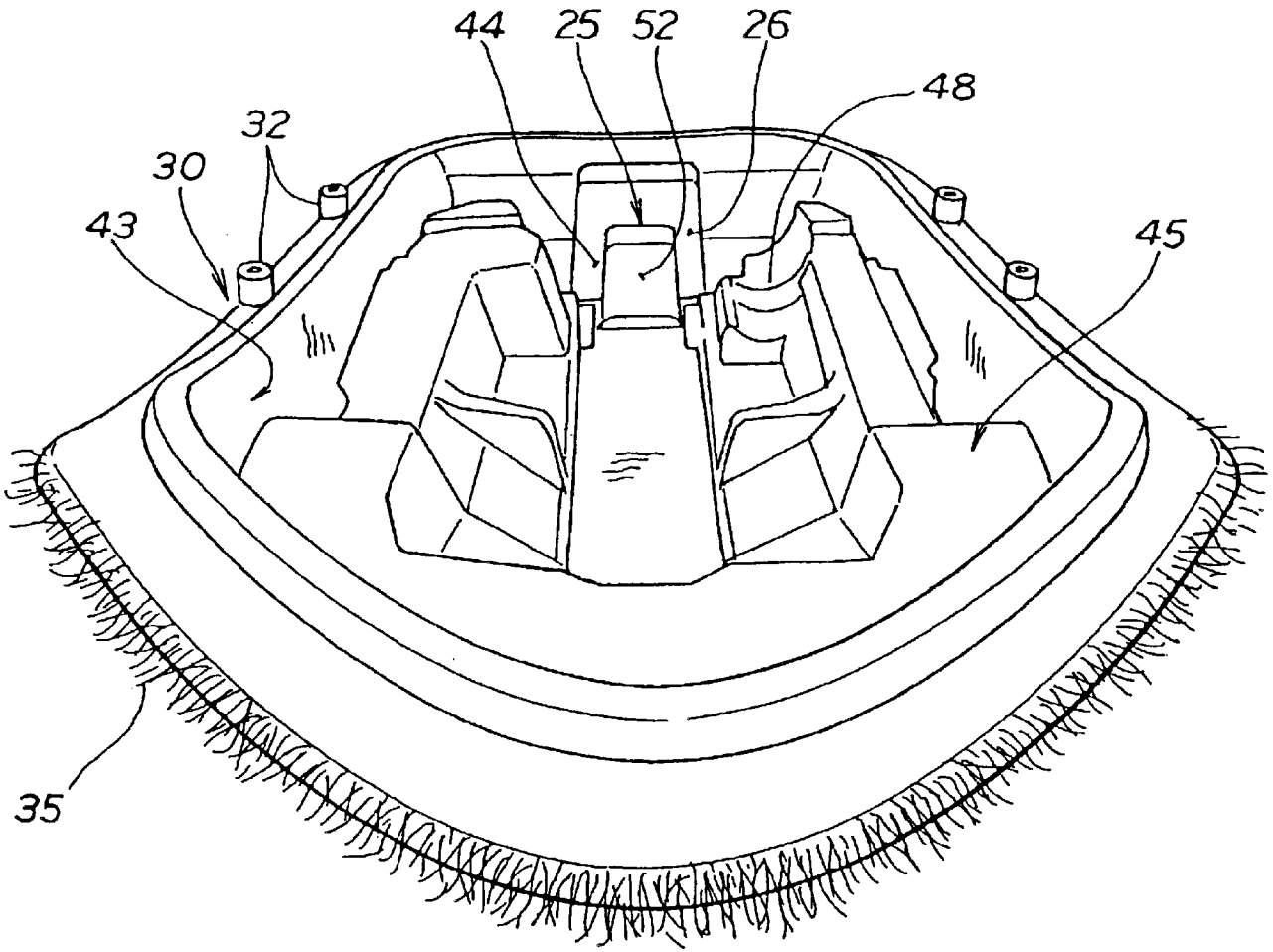
FIG. 10 is a sixth illustration of the method of manufacturing a hull according to the present invention.

FIG. 10 is a sixth illustration of the method of manufacturing the hull according to the present invention, and shows the step of adding the box-like member (No. 2).

The box-like member 25 which is separately prepared is mounted on the predetermined portion 44 of the outer wall 43 being in the soft condition. Subsequently, the buoyancy member 45 is mounted on the center of the outer wall 43.

Subsequently, gages which are not shown are attached to the positioning members 32 . . . of the mold 30, and attaching positions of the box-like member 25 and the buoyancy member 45 (corresponding to the buoyancy member 22 in FIG. 3) by use of the gages.

Next, the step of integrally attaching the box-like member 25 to the outer wall 43 and forming the hollow chamber is started. The resin 34 and the reinforcing fibers 35 are sprayed, in the same manner as in the step of producing the outer wall 43, as shown in FIG. 5. Namely, the resin 34 (see FIG. 5) and the reinforcing fibers 35 (see FIG. 5) are sprayed to the surfaces of the box-like member 25, the buoyancy member 45 and the outer wall 43 which are shown in FIG. 10, to form the third layer.

Incidentally, the gages are detached from the positioning members 32 . . . at the time when the box-like member 25 and the buoyancy member 45 have reached a tentatively fixed condition (the condition where they are fixed without the presence of the gages), to form the third layer.

Subsequently, the third layer is pressed by the roller 42 as shown in FIG. 6, in order to make the thickness of the mixture 41 constituting the third layer uniform.

The third layer is the inner wall 21*a* (see FIGS. 2 and 3), and the inner wall 21*a* (see FIGS. 2 and 3) not yet solidified is completed in this step.

Thus, in the step of integrally attaching to the outer wall 43 and forming the hollow chamber 25*a*, the sprayed third layer is press-formed by the roller 42, so that uniformization of the thickness of the inner wall 21*a* integrally attached to the outer wall 43 can be contrived, and the wall surface can be made flat.

In addition, in the step of integrally attaching to the outer wall 43 and forming the hollow chamber 25*a*, the resin 34 (see FIG. 5) and the reinforcing fibers 35 (see FIG. 5) are sprayed onto the whole area of the outside surfaces 25*b* (see FIG. 9) of the box-like member 25 while being mixed with each other, so that the bonding force between the inner wall 21*a* (see FIG. 2) and the outside surfaces of the box-like member 25 can be raised, and, simultaneously, the bonding force between the inner wall 21*a* (see FIG. 2) and the outer wall 43 is also raised, resulting in that the hollow chamber 25*a* (see FIG. 2) as a whole can be formed to be rigid.

Next, the rudder component mounting seat 26, the mounting surface for the shaft bearing portion 19 (see FIG. 2) and the exhaust pipe mounting surface are formed in predetermined dimensions. The formation will be described in brief. A seat portion forming apparatus which is not shown in the figures is attached to the positioning members 32 . . . of the mold 30, the mixture 41 (corresponding to the third layer) for constituting the rudder component mounting seat 26 is pressed by a predetermined amount by a pressing means of the seat portion forming apparatus, and the mixture (corresponding to the third layer) covering the box-like member 25 is continued to be pressed by a predetermined amount.

On the other hand, an exhaust pipe seat portion forming means which is not shown in the figures is continued to be pressed against the mixture 41 (corresponding to the third layer) on the surface of the exhaust pipe portion 48 of the buoyancy member 45 by a predetermined amount.

By solidifying the resin by use of the seat portion forming apparatus and the exhaust pipe seat portion forming means in this manner, it is possible to finish the rudder component mounting seat 26, the seat portion on the surface of the seat portion 52, and the seat portion for the exhaust pipe to predetermined dimensions.

Incidentally, at the time of solidifying the resin, the work in the condition where the seat portion forming apparatus and the exhaust pipe seat portion forming means are attached is conveyed to a drying area on the downstream side while awaiting solidification of the resin.

Figure 11:
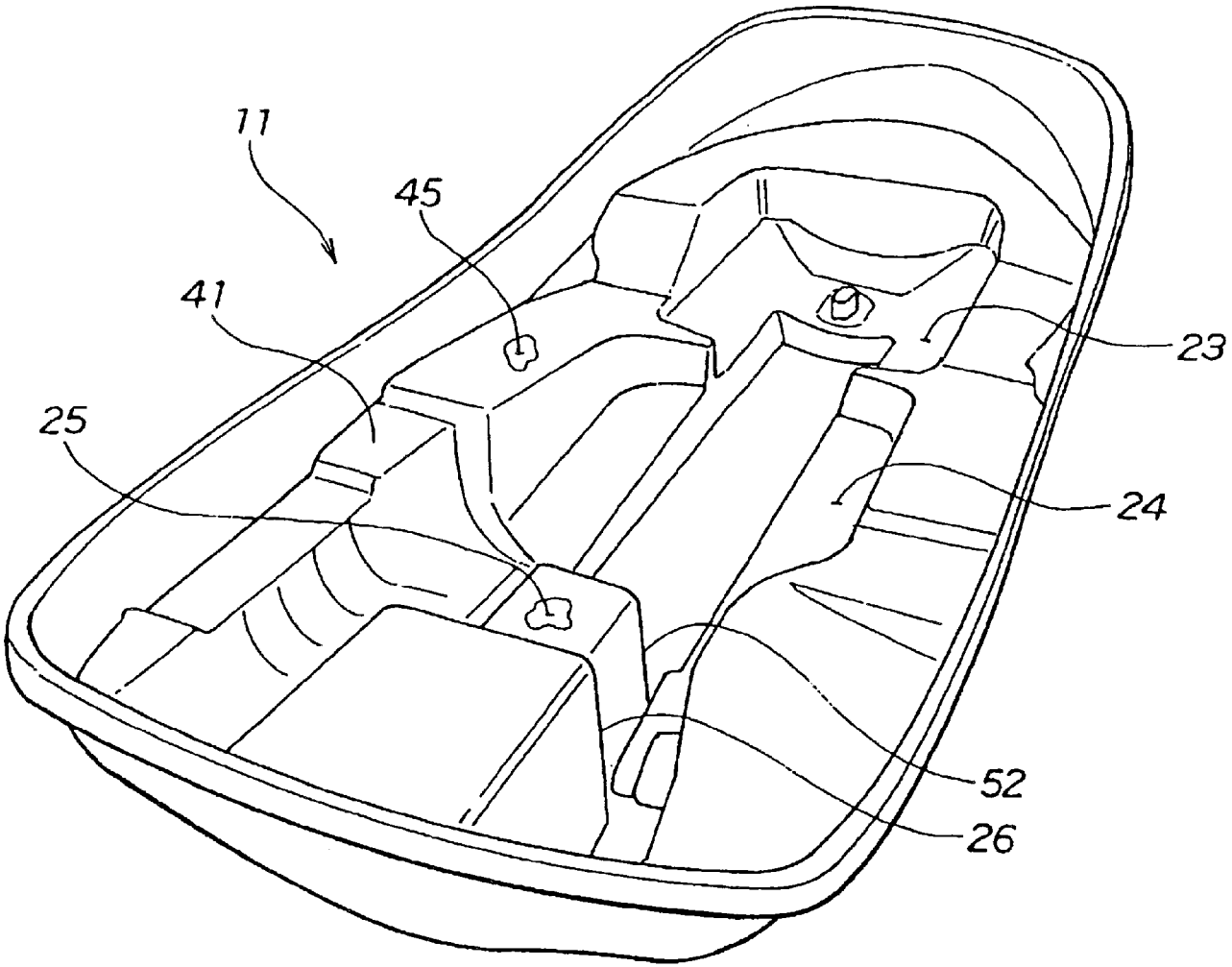
FIG. 11 is a perspective view of the hull manufactured by the method of manufacturing a hull according to the present invention.

FIG. 11 is a perspective view of the hull manufactured by the method of manufacturing the hull according to the present invention, and shows the condition where the buoyancy member 45 (see FIG. 8) and the box-like member 25 (see FIG. 9) are fixed by the mixture 41 of the resin and the reinforcing fibers.

Figure 12:
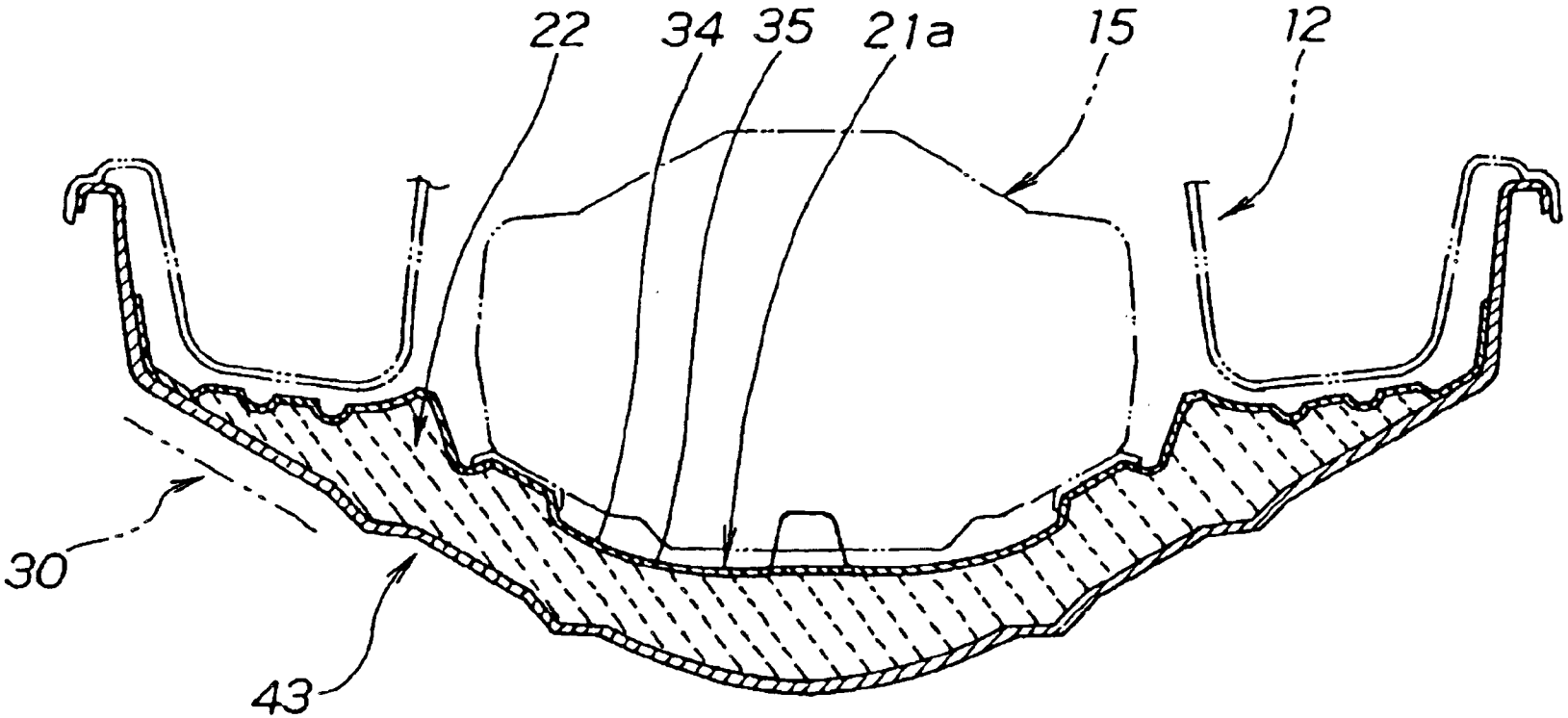
FIG. 12 is a sectional view taken along line 12—12 of FIG. 3.

FIG. 12 is a sectional view taken along line 12—12 of FIG. 3, illustrating the resin and the reinforcing fibers that are sprayed (the first and second layers) to the mold 30 and solidified to thereby produce the outer wall 43 of the hull, then the buoyancy member 22 is mounted on the predetermined position of the outer wall 43, and the resin 34 and the reinforcing fibers 35 are sprayed (corresponding to the third layer) onto the buoyancy member 22 and the outer wall 34 and solidified to thereby form the inner wall 21*a* of the hull and integrally attach the buoyancy member 22 to the outer wall 43.

Incidentally, as has been described above, at the time of producing the outer wall 43, it is unnecessary to wait for the solidification of the sprayed resin (the first and second layers), and the expression "solidified to produce the outer wall 43 of the hull" herein means the condition at the time when the outer wall 43 is completed.

Figure 13:
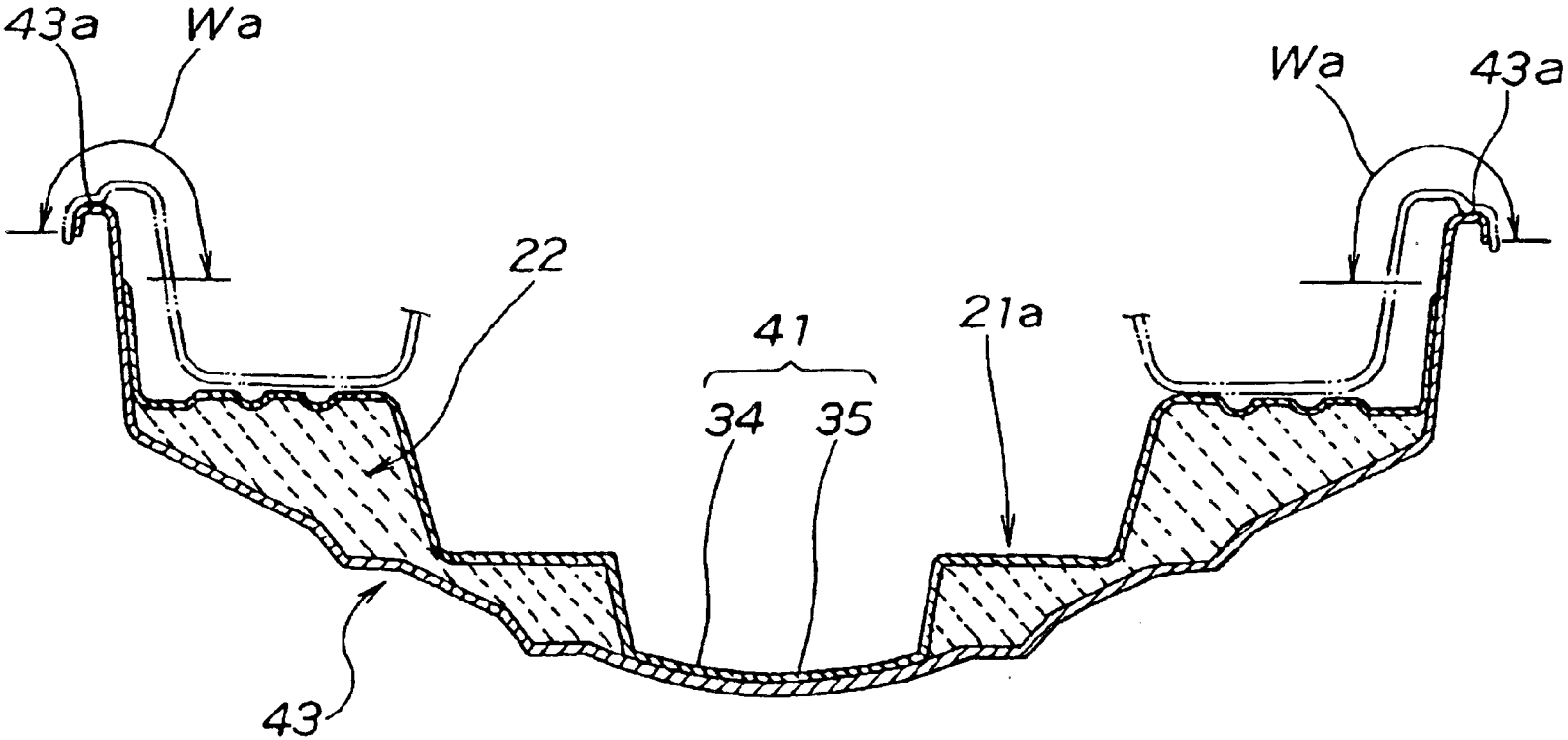
FIG. 13 is a sectional view taken along line 13—13 of FIG. 3.

FIG. 13 is a sectional view taken along line 13—13 of FIG. 3, and shows the condition where the buoyancy member 22 is integrally attached to the outer wall 43 by the inner wall 21*a* formed of the mixture 41 (corresponding to the third layer) of the resin 34 and the reinforcing fibers 35.

Incidentally, while the inner wall 21*a* shown in FIG. 13 is absent in a range Wa at the brim 43*a* of the outer wall 43, the inner wall 21*a* may be provided also in the range Wa. Whether the range Wa where the inner wall 21*a* is absent is to be provided or the inner layer 21*a* is to be laminated also in the range Wa can be arbitrarily selected.

Thus, in the method of manufacturing the hull of the personal watercraft, in the case of attaching the component parts such as the buoyancy member 22 to the hull, the component parts can be attached without using an adhesive. As a result, it is unnecessary to provide an adhesive applicator or an adhesion working area attendant on the adhesion work, so that manufacturing cost can be reduced.

Figure 14:
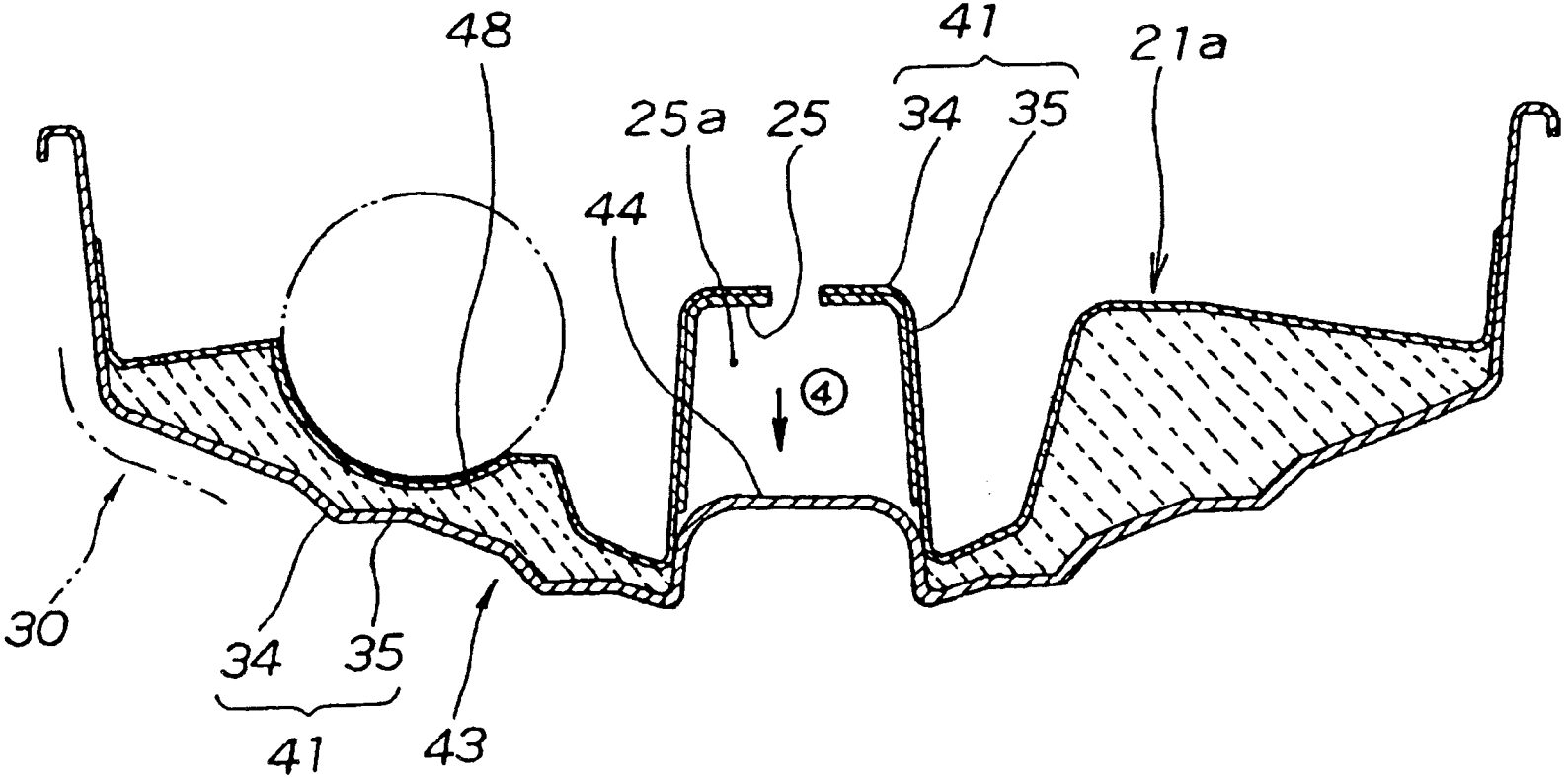
FIG. 14 is a sectional view taken along line 14—14 of FIG. 3.
Figure 15:
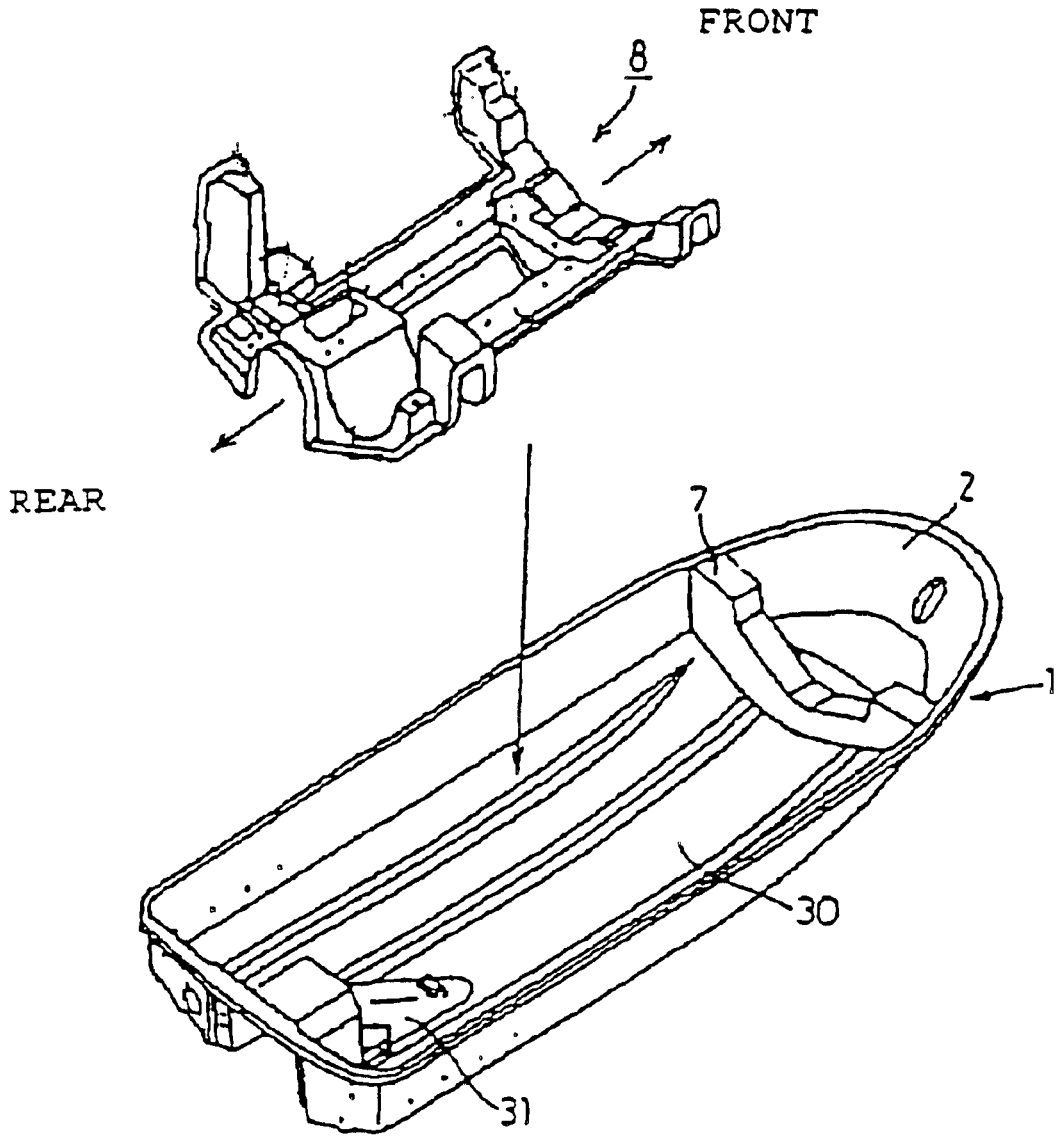
FIG. 15 BACKGROUND ART
FIG. 15 is a illustration of a conventional method of manufacturing a hull.

FIG. 14 is a sectional view taken along line 14—14 of FIG. 3.

The method of manufacturing the hull of the personal watercraft is comprised of the step of spraying the resin 34 and the reinforcing fibers 35 to the mold 30 and solidifying the mixture of the resin 34 and the reinforcing fibers 35 to thereby produce the outer wall 43 of the hull, the step of adding the box-like member 25 to the predetermined portion 44 of the outer wall 43 as indicated by an arrow 4 disposed within a circle and the step of spraying the resin 34 and the reinforcing fibers 35 to the box-like member 25 and the outer wall 43 and solidifying the mixture of the resin 34 and the reinforcing fibers 35 to thereby integrally attach the box-like member 25 to the outer wall 43 and form the hollow chamber 25*a*. As a result, the step of producing the outer wall 43 of the hull and the step of integrally attaching the box-like member 25 to the outer wall 43 and forming the hollow chamber 25*a* can be carried out continuously at the same place. It is unnecessary to convey the outer wall 43 for adhesion of the box-like member 25, the labor for treating the outer wall 43 can be omitted. Thus, manufacturing time of the hull can be shortened. Therefore, the manufacturing cost can be reduced.

Though not shown in the figures, cutting of portions unnecessary in the subsequent step and boring at predetermined positions are carried out after the resin 34 is solidified.

Next, the functions of the hull of the personal watercraft according to the present invention will be described.

The hull 11 includes the outer wall 43 of the hull formed by spraying the resin 34 and the reinforcing fibers 35 to the mold 30 while mixing the resin 34 and the reinforcing fibers 35 and then solidifying the mixture of the resin 34 and the reinforcing fibers 35, the box-like member 25 separately prepared to be added to the predetermined portion 44 of the outer wall 43, and the inner wall 21*a* of the hull formed by spraying the resin 34 and the reinforcing fibers 35 to the box-like member 25 and the outer wall 43 while mixing the resin 34 and the reinforcing fibers 35 and then solidifying the mixture of the resin 34 and the reinforcing fibers 35 to thereby integrally attach the box-like member 25 to the outer wall 43 and form the hollow chamber 25*a*. Therefore, walls 25*c* of the hollow chamber 25*a* can be formed from the resin 34 and the reinforcing fibers 35 by spraying the resin 34 and the reinforcing fibers 35 to the whole area of the outside surfaces 25*b* of the box-like member 25 while mixing the resin 34 and the reinforcing fibers 25, so that the hollow chamber 25*a* can be formed to be rigid.

Moreover, since it is unnecessary to raise the strength of the box-like member 25, it is unnecessary to provide the box-like member 25 with a reinforcement structure such as, for example, plate pieces or grooves, the box-like member 25 can be produced easily, and production cost can be reduced.

As shown in FIG. 2, the box-like member 25 is a member for bearing the drive shaft 17 extending from the engine 16 (see FIG. 1), and the drive shaft 17 can be borne by the rigid hollow chamber 25*a* formed of the box-like member 25 and the inner wall 21*a*.

Incidentally, the structure of the mold 30 of FIG. 4 shown in the embodiment of the present invention is arbitrary; for example, positioning means other than the positioning members 32 may be provided. By providing a plurality of positioning means, positioning can be conducted on the basis of each member.

The shape of the box-like member 25 in FIG. 9 is an example. For example, recesses or projections to be engaged with the positioning means may also be provided.

The shape of the hull 11 is arbitrary.

In addition, while the box-like member 25 is mounted on the outer wall 43 of the hull in the embodiment, the box-like member 25 may be additionally provided on a side surface of the hull or set along the lower surface of the hull. Therefore, it suffices that the box-like member is added to the outer wall 43 of the hull.

The present invention, constituted as described above, displays the following effects.

According to the present invention, a hull includes an outer wall of the hull formed by spraying a resin and reinforcing fibers to a mold while mixing the resin and the reinforcing fibers and then solidifying the mixture of the resin and the reinforcing fibers, a box-like member separately prepared to be added to a predetermined portion of the outer wall, and an inner wall of the hull formed by spraying a resin and reinforcing fibers to the box-like member and the outer wall while mixing the resin and the reinforcing fibers and then solidifying the mixture of the resin and the reinforcing fibers to thereby integrally attach the box-like member to the outer wall and form a hollow chamber. Therefore, walls of the hollow chamber can be formed from the resin and the reinforcing fibers by spraying the resin and the reinforcing fibers to the whole area of the outside surfaces of the box-like member while mixing the resin and the reinforcing fibers, so that the hollow chamber can be formed to be rigid.

Moreover, since it is unnecessary to raise the strength of the box-like member, it is unnecessary to provide the box-like member with a reinforcement structure such as, for example, plate pieces or grooves, production of the box-like member is facilitated, and production cost can be reduced.

According to the present invention, the box-like member is a member for supporting a drive shaft extending from an engine, so that the drive shaft can be supported by the rigid hollow chamber formed of the box-like member and the inner wall.

According to the present invention, the method includes the steps of spraying a resin and reinforcing fibers to a mold while mixing the resin and the reinforcing fibers and then solidifying the mixture of the resin and the reinforcing fibers to thereby produce an outer wall of a hull, the step of adding a box-like member to a predetermined portion of the outer wall, and the step of spraying a resin and reinforcing fibers to the box-like member and the outer wall while mixing the resin and the reinforcing fibers and then solidifying the mixture of the resin and the reinforcing fibers to thereby integrally attach the box-like member to the outer wall and form a hollow chamber. Therefore, the step of producing the outer wall and the step of integrally attaching the box-like member and forming the hollow chamber can be conducted continuously at the same place, the labor of treating the outer wall attendant on an adhesion step can be omitted, and manufacturing time can be shortened. Therefore, the manufacturing cost can be reduced.

According to the present invention, the step of producing the outer wall and the step of integrally attaching to the outer wall and forming the hollow chamber include press-forming a plurality of sprayed layers by a roller. By this, it is possible to contrive uniformization of the thickness of the outer wall, to form the wall surface of the outer wall to be flat, to contrive uniformization of the thickness of the inner wall integrally attached to the outer wall, and to form the wall surface of the inner wall to be flat.

According to the present invention, the step of integrally attaching to the outer wall and forming the hollow chamber includes spraying the resin and the reinforcing fibers to the whole outside surface of the box-like member while mixing the resin and the reinforcing fibers. Therefore, it is possible to raise the bonding force between the inner wall and the outside surface of the box-like member, and, simultaneously, to raise the bonding force between the inner wall and the outer wall, resulting in that the hollow chamber as a whole can be formed to be rigid.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A hull of a personal watercraft comprising:

an outer wall of a hull formed by spraying a resin and reinforcing fibers to a mold while mixing said resin and said reinforcing fibers and then solidifying the mixture of said resin and said reinforcing fibers;

a box-like member separately prepared to be added to a predetermined portion of said outer wall, the box-like member for supporting a drive shaft extending from an engine and a seat portion through which the drive shaft penetrates; and an inner wall of said hull formed by spraying a resin and reinforcing fibers to said box-like member and said outer wall while mixing said resin and said reinforcing fibers and then solidifying the mixture of said resin and said reinforcing fibers so as thereby to integrally attach said box-like member to said outer wall and to form a hollow chamber.

2. The hull of a personal watercraft as set forth in claim 1, wherein said box-like member provides a bearing for the drive shaft extending from the engine.

3. The hull of a personal watercraft as set forth in claim 1, wherein said mold includes a mold surface for forming the outer shape of the hull and positioning members are positioned on an outer side of the mold.

4. The hull of a personal watercraft as set forth in claim 3, wherein said box-like member is positioned relative to the hull by gages attached to the positioning members.

5. The hull of a personal watercraft as set forth in claim 3, and further including a buoyancy member adapted to be positioned within said hull, said buoyancy member being positioned relative to the hull by gages attached to the positioning members.

6. The hull of a personal watercraft as set forth in claim 5, and further including a third layer is formed by spraying a resin and reinforcing fibers to the buoyancy member, the box-like member and the outer wall while mixing the resin and the reinforcing fibers and then solidifying the mixture of said resin and said reinforcing fibers so as thereby to integrally attach said buoyancy member and the box-like member to said outer wall.

7. The hull of a personal watercraft as set forth in claim 6, wherein the third layer is pressed with rollers to form a final inner wall of the personal watercraft.

8. The hull of a personal watercraft as set forth in claim 3, and further including a seat forming apparatus adapted to be positioned within said hull, said seat forming apparatus being positioned relative to the hull by gages attached to the positioning members.

9. The hull of a personal watercraft as set forth in claim 1, wherein the inner wall has an irregular shape and covers outside surfaces the box-like member.

10. The hull of a personal watercraft as set forth in claim 1, wherein the box-like member includes a front wall and a top wall which are substantially rectangular-shaped, and two side walls which are substantially tranezoidal-shaped.

11. A method of manufacturing a hull of a personal watercraft, comprising the following steps:

spraying a resin and reinforcing fibers to a mold while mixing said resin and said reinforcing fibers and then solidifying the mixture of said resin and said reinforcing fibers so as thereby to produce an outer wall of a hull;

separately preparing a box-like member having a vertical surface with a hole for supporting a bearing of a drive shaft;

adding the separately prepared box-like member to a predetermined portion of said outer wall; and spraying a resin and reinforcing fibers to said box-like member and said outer wall while mixing said resin and said reinforcing fibers and then solidifying the mixture of said resin and said reinforcing fibers so as thereby to integrally attach said box-like member to said outer wall and to form a hollow chamber.

12. The method of manufacturing a hull of personal watercraft as set forth in claim 11, wherein the producing of said outer wall and the integrally attaching the box-like member to said outer wall and forming said hollow chamber further includes the step of press forming a plurality of sprayed layers by a roller.

13. The method of manufacturing a hull of personal watercraft as set forth in claim 11, wherein the integrally attaching the box-like member to said outer wall and forming said hollow chamber further includes the step of spraying said resin and said reinforcing fibers to the whale outside surface of said box-like member while mixing said resin and said reinforcing fibers.

14. The method of manufacturing a hull of personal watercraft as set forth in claim 11, and further including the steps of supplying a buoyancy member adapted to be positioned within said hull and positioning said buoyancy member relative to the hull by gages attached to positioning members.

15. The method of manufacturing a hull of a personal watercraft as set forth in claim 14, and further including the step of forming a third layer by spraying a resin and reinforcing fibers to the buoyancy member, the box-like member and the outer wall while mixing the resin and the reinforcing fibers and then solidifying the mixture of said resin and said reinforcing fibers so as thereby to integrally attach said buoyancy member and the box-like member to said outer wall.

16. The method of manufacturing a hull of a personal watercraft as set forth in claim 15, and further including the step of pressing the third layer with rollers to form a final inner wall of the personal watercraft.

17. The method of manufacturing a hull of a personal watercraft as set forth in claim 11, and further including the step of positioning a seat forming apparatus within said hull, said seat forming apparatus being positioned relative to the hull by gages attached to the positioning members.

18. The method of manufacturing a hull of a personal watercraft as set forth in claim 11, and further including the step of pressing the outer wall with rollers to form the outer wall of the personal watercraft.

19. The method of manufacturing a hull of a personal watercraft as set forth in claim 11, and further including the step of pressing the inner wall with rollers to form the inner wall of the personal watercraft.

20. A hull of a personal watercraft formed by the method of manufacturing according to claim 11.

* * * * *